US011144015B2

(12) United States Patent
Sano et al.

(10) Patent No.: US 11,144,015 B2
(45) Date of Patent: Oct. 12, 2021

(54) ANTENNA DEVICE AND TIMEPIECE

(71) Applicant: CASIO COMPUTER CO., LTD., Tokyo (JP)

(72) Inventors: Takashi Sano, Fussa (JP); Daisuke Uematsu, Akishima (JP); Yohei Kawaguchi, Akishima (JP); Tatsumi Ichimura, Ome (JP); Takumi Yasuda, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 404 days.

(21) Appl. No.: 16/150,420

(22) Filed: Oct. 3, 2018

(65) Prior Publication Data

US 2019/0107813 A1 Apr. 11, 2019

(30) Foreign Application Priority Data

Oct. 5, 2017 (JP) ..... JP2017-194911

(51) Int. Cl.

| | |
|---|---|
| ***G04G 17/04*** | (2006.01) |
| ***G04G 21/04*** | (2013.01) |
| ***G04B 37/22*** | (2006.01) |
| ***G04R 60/08*** | (2013.01) |

(52) U.S. Cl.

CPC ..... *G04G 21/04* (2013.01); *G04B 37/225* (2013.01); *G04G 17/04* (2013.01); *G04R 60/08* (2013.01)

(58) Field of Classification Search

CPC ..... G04G 21/04; G04G 17/04; G04B 37/225; G04R 60/08

See application file for complete search history.

(56) References Cited

U.S. PATENT DOCUMENTS

| | | | | |
|---|---|---|---|---|
| 9,195,221 | B2 | 11/2015 | Oshita et al. | |
| 2015/0268640 | A1 | 9/2015 | Oshita et al. | |
| 2016/0049721 | A1* | 2/2016 | Aizawa | G04G 21/04 343/718 |
| 2018/0287248 | A1* | 10/2018 | Han | H01Q 13/10 |

FOREIGN PATENT DOCUMENTS

| | | | |
|---|---|---|---|
| JP | 2015-184090 | A | 10/2015 |

* cited by examiner

*Primary Examiner* — Sean Kayes

(74) *Attorney, Agent, or Firm* — Scully Scott Murphy & Presser

(57) ABSTRACT

An antenna device including a case main body made of synthetic resin, an antenna made of metal and provided on an upper portion of the case main body so as to receive radio waves, an electronic component provided on a side portion of the case main body, and a protective connection member which includes a protection section which protects the electronic component and a connection section which is connected to the antenna.

20 Claims, 4 Drawing Sheets

ANTENNA DEVICE AND TIMEPIECE

CROSS-REFERENCE TO RELATED APPLICATION

This application is based upon and claims the benefit of priority from the prior Japanese Patent Application No. 2017-194911, filed Oct. 5, 2017, the entire contents of which are incorporated herein by reference.

BACKGROUND

1. Field of the Invention

The present invention relates to an antenna device for use in an electronic device such as a wristwatch, and a timepiece equipped with the antenna device.

2. Description of the Related Art

For example, a wristwatch is known which has a structure where an antenna has been provided in its case main body, as described in Japanese Patent Application Laid-Open (Kokai) Publication No. 2015-184090.

In this wristwatch, a metal switch button is provided on a side portion of the case main body, and electrically connected by a connection member to a metal rear cover provided on a lower portion of the case main body so as to take measures against static electricity.

In this wristwatch, measures against static electricity can be taken by the antenna being provided in the case main body and the metal switch button being connected to the metal rear cover. However, in a case where a metal antenna is provided on the upper part of the case main body, the switch button is arranged close to the antenna. As a result, the reception of radio waves by the antenna is easily affected by the switch button, which leads to degradation and instability of the antenna characteristics.

SUMMARY

In accordance with one embodiment, there is provided an antenna device comprising: a case main body made of synthetic resin; an antenna made of metal and provided on an upper portion of the case main body so as to receive radio waves; an electronic component provided on a side portion of the case main body; and a protective connection member which includes a protection section which protects the electronic component and a connection section which is connected to the antenna.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

An embodiment applied to a wristwatch is hereinafter described with reference to FIG. 1 to FIG. 4.

Figure 1:
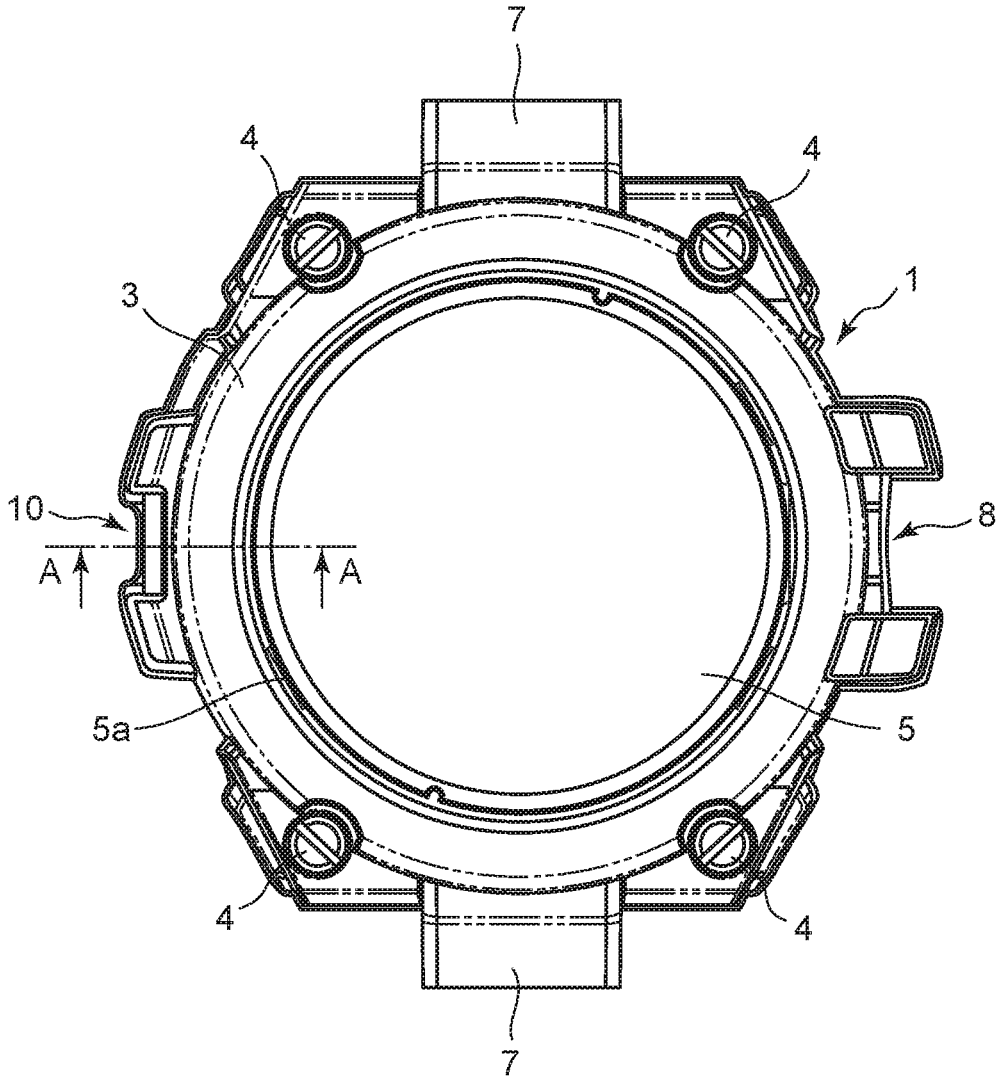
FIG. 1 is an enlarged front view of an embodiment in which the present invention has been applied to a wristwatch.
Figure 2:
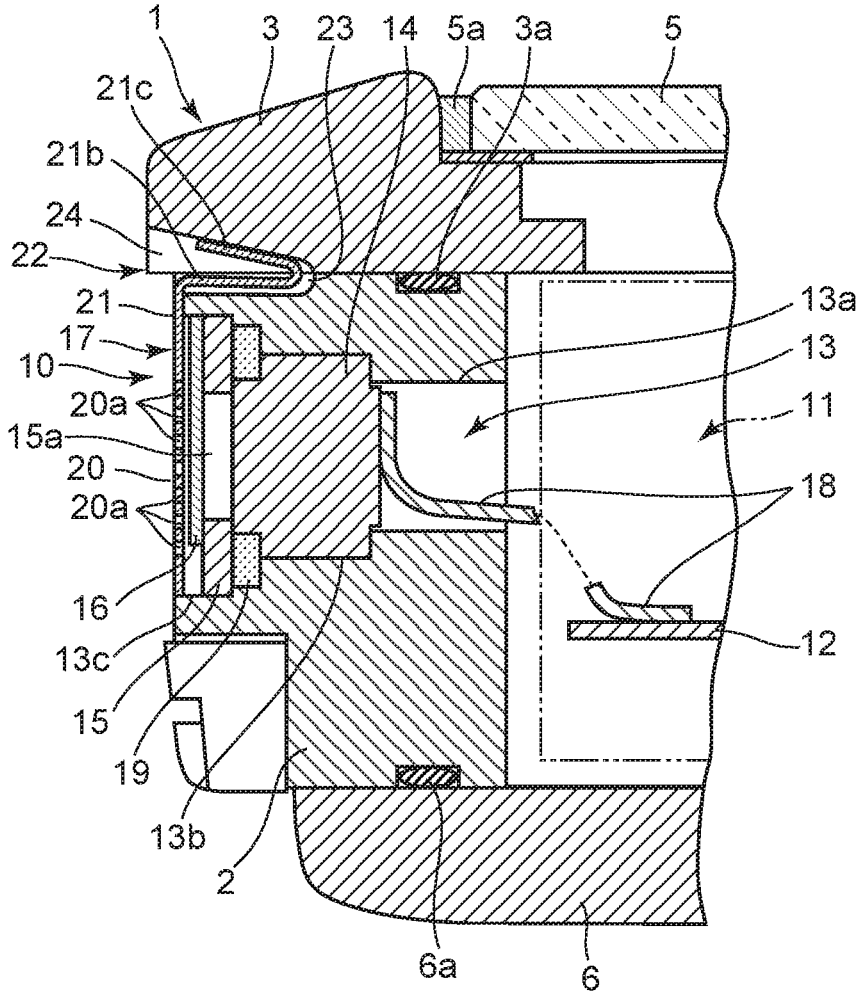
FIG. 2 is an enlarged sectional view of the main section of the wristwatch taken along line A-A shown in FIG. 1.

This wristwatch includes a wristwatch case 1, as shown in FIG. 1 and FIG. 2. The wristwatch case 1 includes a case main body 2 made of hard synthetic resin, and an antenna 3 made of metal such as stainless steel. The case main body 2 is formed in a substantially ring shape as a whole.

The antenna 3, which is a GPS antenna for receiving radio waves of high frequency (for example, 1575.42 MHz), is formed in a ring shape substantially the same as that of the case main body 2, and functions as a bezel of the wristwatch, as shown in FIG. 1 and FIG. 2. This antenna 3 is attached to an upper portion of the case main body 2 by a plurality of screws 4 via a waterproof ring 3*a*.

An upper opening of this wristwatch case 1, that is, an upper opening of the antenna 3 is provided with a timepiece glass 5 via a glass gasket 5*a*, as shown in FIG. 1 and FIG. 2. To a lower portion of this wristwatch case 1, that is, a lower portion of the case main body 2, a rear cover 6 is attached via a waterproof gasket 6*a*. This rear cover 6 need not be made of metal, and may be made of non-metal such as ceramic. Also, on each side portion of the wristwatch case 1 on the 12 o'clock side and the 6 o'clock side, a band attachment section 7 is provided to which a timepiece band (not shown) is attached, as shown in FIG. 1. Moreover, on a side portion of the wristwatch case 1 on the 3 o'clock side, a switch button 8 is provided. On a side portion of the wristwatch case 1 on the 9 o'clock side, that is, a side portion of the case main body 2 on the 9 o'clock side, a sensor section 10 is provided, as shown in FIG. 2.

Inside this wristwatch case 1, that is, inside the case main body 2, a timepiece module 11 is provided, as shown in FIG. 2. This timepiece module 11 includes various electronic components required for a timepiece function, such as a timepiece movement which moves pointers to indicate time, a display section which electrooptically displays information such as time (both are not shown), and a circuit board 12 for electrically controlling and driving these components.

The sensor section 10 is to detect pressure outside the wristwatch case 1, and is provided in a through hole 13 in the case main body 2, as shown in FIG. 2. This through hole 13 is constituted by a small-diameter hole 13*a*, an intermediate-diameter hole 13*b*, and a large-diameter hole 13*c* sequentially provided from the inner side of the case main body 2 to the outer side.

Also, the sensor section 10 includes a pressure sensor 14 which detects pressure outside the wristwatch case 1, a protective plate 15 which protects this pressure sensor 14, a presser plate 16 which presses this protective plate 15, and a sensor cover 17 which is a protective connection member that covers the presser plate 16 so as to protect the pressure sensor 14, as shown in FIG. 2. The pressure sensor 14 is arranged in the intermediate-diameter hole 13*b* of the through hole 13, and electrically connected to the circuit board 12 of the timepiece module 11 via a flexible wiring board 18.

The protective plate 15, which is a disc plate having an air hole 15*a* provided at the center, is arranged in the large-diameter hole 13*c* of the through hole 13 via a ring-shaped cushioning material 19, and positioned on the outer surface of the pressure sensor 14, as shown in FIG. 2. The presser plate 16, which is a mesh-shaped panel, is structured to be arranged in the large-diameter hole 13*c* of the through hole and positioned on the outer surface of the protective plate 15 so as to press the protective plate 15 toward the pressure sensor 14.

That is, this presser plate 16 is structured to press the protective plate 15 toward the pressure sensor 14 so that the protective plate 15 presses the cushioning material 19 against the pressure sensor 14, as shown in FIG. 2. As a result, the pressure sensor 14 is fixed in the intermediate-diameter hole 13*b* with it being pressed against an edge portion of the small-diameter hole 13*a* of the through hole 13.

Figure 3:
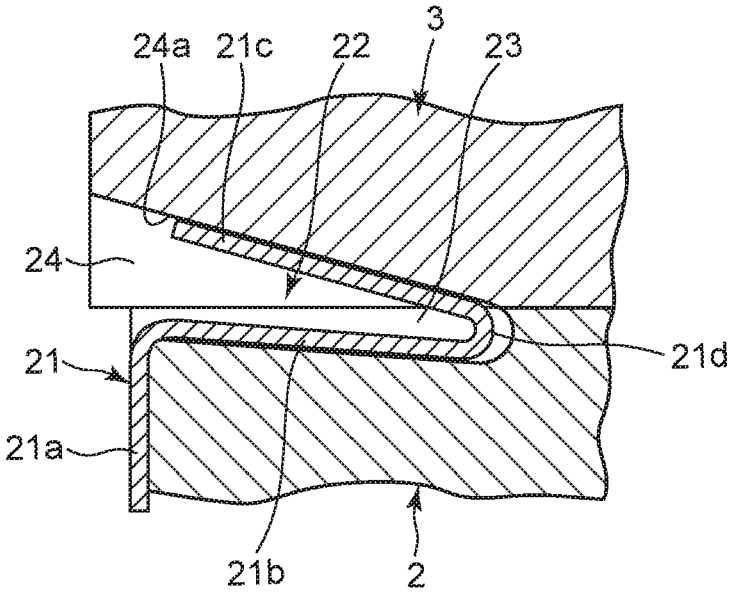
FIG. 3 is an enlarged sectional view of the main section, in which a connection section of a sensor cover in a sensor section shown in FIG. 2 is in contact with an antenna for connection.

The sensor cover 17 is a protective connection member, and includes a protection section 20 arranged on the outer surface of the case main body 2 while covering the presser plate 16 and a connection section 21 electrically connected to the antenna 3, as shown in FIG. 2 and FIG. 3. This sensor cover 17 is formed of a thin plate member made of metal such as stainless steel, in which the protection section 20 and the connection section 21 are integrally formed. The protection section 20 has a number of small holes 20*a*, and is provided on the outer surface of the case main body 2 while covering the presser plate 16.

Figure 4:
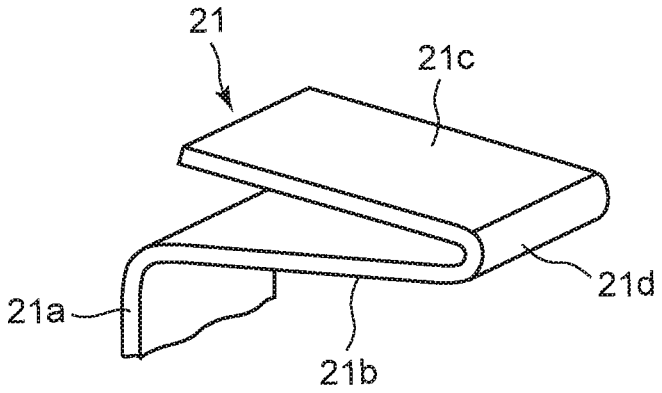
FIG. 4 is an enlarged perspective view of the connection section of the sensor cover shown in FIG. 3.

The connection section 21 is arranged to be opposed to the antenna 3, and connected to the antenna 3 with reinforced capacity coupling, as shown in FIG. 2 to FIG. 4. Here, the capacity of capacity coupling is proportional to area and inversely proportional to distance. Also, coupling impedance is inversely proportional to capacity and also inversely proportional to frequency.

In the present embodiment, a relation among a capacity C of capacity coupling, a vacuum permittivity ε0, a contact area S, and a space (distance) between the sensor section 10 and the antenna 3 is $$C=\varepsilon 0\cdot(S/d).$$

Accordingly, the connection section 21 is formed such that it has a large contact area with respect to the antenna 3 and has small contact resistance with respect to the antenna 3. Also, the distance between the sensor section 10 and the antenna 3 is set to be short.

The connection section 21 is structured such that it extends from the protection section 20 of the sensor cover 17 along the outer surface of the case main body 2 toward an upper portion of the case main body 2 so as to be inserted into an insertion groove section 22 provided between the case main body 2 and the antenna 3, and is folded in this insertion groove section 22 so as to be close to the lower surface of the antenna by resiliently coming in surface or partial contact therewith, as shown in FIG. 2 and FIG. 3.

That is, this connection section 21 is formed in a wide-width band shape, and includes a coupling section 21*a* extending from the protection section 20 of the sensor cover 17 along the outer surface of the case main body 2, an extended section 21*b* formed by the connection section 21 being folded at a tip of the coupling section 21*a* so as to be inserted into the insertion groove section 22, and a contact section 21*c* formed by the connection section 21 being folded back at a folded section 21*d* at a tip of the extended section 21*b* so as to resiliently come in contact with the lower surface of the antenna 3, as shown in FIG. 2 to FIG. 4.

Also, the area of the connection section 21 or the area of the contact section 21*c* resiliently coming in contact with the lower surface of the antenna 3 is required to have a predetermined size with respect to the area of the protection section 20, and therefore the area of the connection section 21 or the area of the contact section 21*c* is equal to or larger than 10% of the area of the protection section 20.

The insertion groove section 22 between the case main body 2 and the antenna 3 includes an extended groove 23 provided on the upper surface of the case main body 2 and a connection groove 24 provided on the lower surface of the antenna 3, and is formed to be elongated in the insertion direction of the connection section 21 of the sensor cover 17 with these grooves corresponding to each other, as shown in FIG. 2 and FIG. 3. Also, this insertion groove section 22 is formed such that the vertical width of its insertion port where the connection section 21 is inserted is wide and gradually becomes narrower toward its inner portion.

The extended groove 23 provided on the upper surface of the case main body 2 is formed to be gradually deeper from the outer surface side of the case main body 2 toward the inner surface side such that its groove width is slightly wider than the width of the connection section 21, as shown in FIG. 3. As a result, the extended groove 23 is structured such that the contact section 21*c* is easily folded back at the tip of the extended section 21*b* when the extended section 21*b* of the connection section 21 is inserted.

The connection groove 24 provided on the lower surface of the antenna 3 is provided corresponding to the extended groove 23 of the case main body 2, as shown in FIG. 3. This connection groove 24 is formed to be gradually higher (deeper) from the inner peripheral side of the antenna 3 toward the outer peripheral side such that its groove width is slightly wider than the width of the connection section 21, as with the extended groove 23 of the case main body 2.

As a result, this connection groove 24 has an inner upper surface formed as a connection surface 24*a* that is an inclined surface whose height gradually increases from the inner peripheral side of the antenna 3 toward the outer peripheral side, as shown in FIG. 3. Accordingly, this connection groove 24 is structured such that a substantially entire surface of the folded contact section 21*c* resiliently comes in contact with the connection surface 24*a* in a surface contact state when the contact section 21*c* of the connection section 21 is folded back at the folded section 21*d* at the tip of the extended section 21*b*.

Accordingly, this connection section 21 has a large contact area with respect to the antenna 3 and has small contact resistance with respect to the antenna 3, as shown in FIG. 2 to FIG. 4. Also, the sensor section 10 is arranged such that the distance between the protection section 20 of the sensor cover 17 and the antenna 3 is short.

Next, the mechanism of this wristwatch is described.

In the assembly of this wristwatch, the timepiece glass 5 is attached in advance to the upper opening of the antenna 3 via the glass gasket 5*a*. This antenna 3 is arranged on the upper portion of the case main body 2 via the waterproof ring 3*a* and is attached by the plurality of screws 4. Here, the connection groove 24 provided on the lower surface of the antenna 3 and the extended groove 23 provided on the upper end of the case main body 2 are arranged corresponding to each other. As a result, the insertion groove section 22 is formed between the case main body 2 and the antenna 3.

In this state, the sensor section 10 is attached into the through hole 13 provided in the side portion of the case main body 2. That is, the pressure sensor 14 of the sensor section 10 is inserted and arranged inside the intermediate-diameter hole 13*b* of the through hole 13 of the case main body 2 from the large-diameter hole 13*c* side. Here, the flexible wiring board 18 is connected in advance to the pressure sensor 14, and then inserted into the through hole 13 together with the pressure sensor 14 so as to be positioned inside the case main body 2.

Then, the protective plate 15 is inserted into the large-diameter hole 13*c* of the through hole 13 together with the cushioning material 19, and arranged on the outer surface of the pressure sensor 14 together with the cushioning material 19. In this state, the presser plate 16 is arranged inside the large-diameter hole 13*c* of the through hole 13 and presses the protective plate 15 against the pressure sensor 14. As a result, the pressure sensor 14 is fixed inside the intermediate-diameter hole 13*b* of the through hole 13. Then, the protection section 20 of the sensor cover 17 is arranged on the outer surface of the case main body 2 so as to cover the presser plate 16.

The sensor section 10 is mounted in the through hole 13 of the case main body 2 as described above. In this state, pressure outside the wristwatch case 1 is applied to the pressure sensor 14 through the small holes 20*a* provided in the protection section 20 of the sensor cover 17, the mesh-shaped presser plate 16, and the air hole 15*a* of the protective plate 15. As a result, the pressure sensor 14 can detect the pressure outside the wristwatch case 1.

On the other hand, when the protection section 20 of the sensor cover 17 is to be arranged on the outer surface of the case main body 2, the extended section 21*b* and the contact section 21*c* of the connection section 21 are inserted into the insertion groove section 22 provided between the case main body 2 and the antenna 3. Here, the insertion groove section 22 is formed to be elongated to the insertion direction of the connection section 21 in the sensor cover 17, and the vertical width of its insertion port where the connection section 21 is inserted is wide and gradually becomes narrower toward its inner portion. Therefore, the extended section 21*b* and the contact section 21*c* of the connection section 21 are smoothly and easily inserted into the insertion groove section 22. In the present embodiment, the extended groove 23 of the case main body 2 is formed to be gradually deeper from the outer peripheral side toward the inner peripheral side. Since the connection groove 24 of the antenna 3 is formed to be gradually higher (deeper) from the inner peripheral side toward the outer peripheral side, the folded section 21*d* of the connection section 21 is easily arranged in a deep portion of the extended groove 23 of the case main body 2, and the extended section 21*b* and the contact section 21*c* of the connection section 21 are easily and favorably inserted into the insertion groove section 22.

Also, when the extended section 21*b* and the contact section 21*c* of the connection section 21 are inserted into the insertion groove section 22, the folded section 21*d* functions as a spring section. The resilience of this folded section 21*d* causes a substantially entire surface of the folded contact section 21*c* to resiliently come in surface contact with the inclined connection surface 24*a* provided inside the connection groove 24. Accordingly, the connection section 21 is reliably connected to the antenna 3. In addition, the contact area of the connection section 21 with respect to the antenna 3 is increased, and the contact resistance is decreased.

Then, the timepiece module 11 is mounted in the case main body 2. Here, the flexible wiring board 18 of the pressure sensor 14 is connected in advance to the circuit board 12 of the timepiece module 11. Then, the rear cover 6 is attached together with the waterproof gasket 6*a* to the lower portion of the case main body 2. As a result, the assembly of the wristwatch is completed.

In the wristwatch assembled as described above, the wristwatch case 1 is constituted by the synthetic-resin-made case main body 2 and the metal antenna 3 provided on the upper portion of this case main body 2. Therefore, radio waves can be favorably received by this antenna 3. Also, in this wristwatch, the sensor section 10 is provided on the side portion of the case main body 2 on the 9 o'clock side. Therefore, pressure outside the wristwatch case 1 can be favorably detected by the pressure sensor 14 of this sensor section 10.

Also, in the sensor section 10, the pressure sensor 14 is protected in the through hole 13 in the side portion of the case main body 2 by the protective plate 15 via the cushioning material 19. By this protective plate 15 being pressed against the pressure sensor 14 by the presser plate 16, the pressure sensor 14 is fixed inside the through hole 13. Therefore, pressure outside the wristwatch case 1 can be reliably and favorably detected.

Furthermore, in this sensor section 10, with the protection section 20 of the sensor cover 17 that is a protective connection member being attached to the outer surface of the case main body 2 so as to cover the presser plate 16, the connection section 21 of the sensor cover 17 is connected to the antenna 3 with reinforced capacity coupling. Therefore, although the sensor section 10 is arranged close to the antenna 3, the reception of radio waves by the antenna 3 is less affected by the sensor section 10, and the radio waves can be favorably received by the antenna 3. In addition, measures against static electricity can be taken.

That is, the connection section 21 of the sensor cover 17 is formed having a large contact area with respect to the antenna, and can therefore be connected to the antenna 3 with reinforced capacity coupling. Accordingly, although the sensor section 10 is arranged close to the antenna 3, effects by the sensor section 10 on the reception of radio waves by the antenna 3 can be reduced. Also, the reliable connection between the connection section 21 of the sensor cover 17 and the antenna 3 reliably provides an electrostatic route, and thereby allows measures against static electricity to be taken.

In the present embodiment, the connection section 21 of the sensor cover 17 is a thin plate made of metal such as stainless steel and formed having a wide-width band shape, and includes the extended section 21*b* formed by the connection section 21 being folded at the tip of the coupling section 21*a* extending from the protection section 20 of the sensor cover 17 along the outer surface of the case main body 2 so as to be inserted into the insertion groove section 22 between the case main body 2 and the antenna 3, and the contact section 21*c* formed by the connection section 21 being folded back at the folded section 21*d* at the tip of the extended section 21*b* so as to resiliently come in contact with the connection surface 24*a* of the antenna 3. Therefore, the contact area of the connection section 21 with respect to the antenna is increased, and the connection section 21 can be reliably connected to the antenna 3.

Also, the insertion groove section 22 includes the extended groove 23 on the upper surface of the case main body 2 and the connection groove 24 on the lower surface of the antenna 3, which are formed to be elongated to the inserting direction of the connection section 21 of the sensor cover 17. Also, the vertical width of the insertion port of the insertion groove section 22 where the connection section 21 is inserted is wide and gradually becomes narrower toward its inner portion. Therefore, the extended section 21*b* and the contact section 21*c* of the connection section 21 are smoothly and easily inserted into the insertion groove section 22. Accordingly, it is only required to insert the connection section 21 of the sensor cover 17 into the insertion groove section 22, which enhances operability in the assembly.

As for the connection section 21, the extended section 21*b* is inserted into the extended groove 23 of the case main body 2, and the contact section 21*c* is folded back at the folded section 21*d* and resiliently comes in surface contact with the connection surface 24*a* of the antenna 3. Therefore, the contact area of the contact section 21*c* with respect to the antenna 3 is increased, and the contact section 21*c* is connected with it being in reliable contact with the antenna 3. As a result, the connection section 21 can be connected to the antenna 3 with reinforced capacity coupling.

Also, the extended groove 23 of the case main body 2 is formed to be gradually deeper from the outer surface side of the case main body 2 toward the inner surface side. Therefore, when the extended section 21*b* of the connection section 21 is inserted, the contact section 21*c* is easily and smoothly folded back by the folded section 21*d* inside the extended groove 23. Also, the connection groove 24 of the antenna 3 is formed to be gradually higher (deeper) from the inner peripheral side of the antenna 3 toward the outer peripheral side. Accordingly, by the resilience of the folded section 21*d*, the contact section 21*c* reliably and favorably comes in contact with a large area of the connection surface 24*a* inside the connection groove 24.

Furthermore, the connection surface 24*a* in the connection groove 24 is formed as an inclined surface that is gradually higher from the inner peripheral side of the antenna 3 toward the outer peripheral side. Therefore, when the contact section 21*c* folded back at the folded section 21*d* in the extended groove 23 is to come in contact with the antenna 3, the resilience of the folded section 21*d* causes a substantially entire surface of the contact section 21*c* to resiliently come in surface contact with the entire connection surface 24*a* in the connection groove 24. As a result, the contact section 21*c* reliably and favorably comes in contact with a large area of the antenna 3.

Thus, this connection section 21 has a large contact area with respect to the antenna 3 and small contact resistance with respect to the antenna 3, and is reliably connected to the antenna 3 by the resilience of the folded section 21*d*. Accordingly, the connection section 21 can be connected to the antenna 3 with reinforced capacity coupling. Also, although the distance between the sensor section 10 and the antenna 3 is short, the contact area of the connection section 21 with respect to the antenna 3 can be increased by the structure where the connection section 21 is folded back to come in contact with the antenna 3.

As described above, the wristwatch includes the case main body 2 made of synthetic resin, the antenna 3 made of metal and provided on the upper portion of the case main body 2 to receive radio waves, the sensor section 10 provided on the side portion of the case main body 2, and the sensor cover 17 that is a protective connection member which protects the sensor section 10 and is connected to the antenna 3 with reinforced capacity coupling. Therefore, the antenna characteristics can be prevented from being degraded and can be stabilized.

That is, in this wristwatch, by the sensor cover 17 being connected to the antenna 3 with reinforced capacity coupling, effects by the sensor section 10 on the reception of radio waves by the antenna 3 can be reduced although the sensor section 10 is arranged close to the antenna 3. Therefore, the antenna characteristics can be prevented from being degraded and can be stabilized.

Also, by the sensor cover 17 being formed having a large contact area with respect to the antenna 3, the sensor cover 17 can be connected to the antenna 3 with reinforced capacity coupling. Therefore, effects by the sensor section 10 on the reception of radio waves by the antenna 3 can be reduced. As a result, the antenna characteristics can be prevented from being degraded and can be stabilized.

Furthermore, this sensor cover 17 is formed having a large contact area with respect to the antenna 3, which allows a decrease in the contact resistance of the sensor cover 17 with respect to the antenna 3. By this structure as well, the sensor cover 17 can be connected to the antenna 3 with reinforced capacity coupling, whereby the antenna characteristics can be prevented from being degraded and can be stabilized.

Still further, in this wristwatch, the connection section 21 of the sensor cover 17 is extended from the outside of the sensor section 10 along the upper surface of the case main body 2, and then folded to come in surface contact with the lower surface of the antenna 3. Therefore, the contact area of the connection section 21 with respect to the antenna 3 can be increased.

That is, the connection section 21 of the sensor cover 17 is a thin plate made of metal such as stainless steel in a wide-width band shape, and includes the coupling section 21*a* extending from the protection section 20 of the sensor cover 17 along the outer surface of the case main body 2, the extended section 21*b* extended from the tip of the coupling section 21*a* along the upper surface of the case main body 2, and the contact section 21*c* formed by the connection section 21 being folded back at the folded section 21*d* at the tip of the extended section 21*b* so as to resiliently come in surface contact with the lower surface of the antenna 3. Therefore, the contact area with respect to the antenna 3 can be reliably increased.

Also, in this wristwatch, the insertion groove section 22 where the connection section 21 of the sensor cover 17 is inserted is provided between the case main body 2 and the antenna 3 in a manner to be elongated to the insertion direction. Accordingly, by the extended section 21*b* of the connection section 21 being formed to be long, the contact section 21*c* folded back at the folded section 21*d* can be formed to be long. As a result, the contact area of the contact section 21*c* with respect to the antenna 3 can be reliably increased.

Moreover, the insertion groove section 22 is formed such that the vertical width of its insertion port where the connection section 21 is inserted is wide and gradually becomes narrower toward its inner portion. Accordingly, the connection section 21 of the sensor cover 17 can be easily and smoothly inserted into the insertion groove section 22 with the antenna 3 being attached to the upper portion of the case main body 2. Therefore, operability in the assembly is excellent, and cost reduction can be achieved.

When the extended section 21*b* and the contact section 21*c* of the connection section 21 are inserted into the insertion groove section 22, since the inner portion of the extended groove 23 has been deeply formed, the contact section 21*c* can be reliably and favorably folded back at the folded section 21*d* inside this extended groove 23, and therefore can reliably and favorably come in resilient surface contact with the connection surface 24*a* of the antenna 3.

Also, the connection groove 24 of the insertion groove section 22 positioned on the lower surface of the antenna 3 is formed to be deeper from the inner peripheral side of the antenna 3 toward the outer peripheral side, and the connection surface 24*a* is inclined and provided in the inner part. Therefore, when the extended section 21*b* of the connection section 21 is inserted into the extended groove 23 and the contact section 21 is folded back at the folded section 21*d*, the resilience of the folded section 21*d* can cause the contact section 21*c* to reliably and favorably come in contact with the connection surface 24*a* provided to be inclined in the connection groove 24.

Furthermore, in this wristwatch, the distance between the sensor section 10 and the antenna 3 is set to be short. By this structure as well, the sensor cover 17 can be connected to the antenna 3 with reinforced capacity coupling. Accordingly, effects by the sensor section 10 on the reception of radio waves by the antenna 3 can be reduced. Therefore, the antenna characteristics can be prevented from being degraded and can be stabilized.

Still further, in this wristwatch, although the distance between the sensor section 10 and the antenna 3 is short, since the connection section 21 is folded to come in contact with the antenna 3, an increase in the contact area of the connection section 21 with respect to the antenna 3 can be achieved and also a decrease in the contact resistance of the connection section 21 can be achieved. As a result, effects by the sensor section 10 on the reception of radio waves by the antenna 3 can be reduced. By this structure as well, the antenna characteristics can be prevented from being degraded and can be stabilized.

In the above-described embodiment, the contact section 21*c* of the connection section 21 of the sensor cover 17 resiliently comes in contact with the connection surface 24*a* of the connection groove 24 provided on the lower surface of the antenna 3. However, the present invention is not limited thereto. For example, a structure may be adopted in which a wedge-shaped pressing piece is inserted between the extended section 21*b* and the contact section 21*c* of the connection section 21 such that the contact section 21*c* comes in pressure contact with the connection surface 24*a* of the connection groove 24. Also, the present invention is not limited thereto and, in a case where operability in the assembling is not required to be taken into consideration, a structure may be adopted in which the contact section 21*c* is pressed against the connection surface 24*a* of the connection groove 24 by a screw.

Here, in the above-described embodiment, the connection section 21 can be connected to the antenna 3 with reinforced capacity coupling as long as the connection section 21 and the antenna 3 are close to each other. That is, they are not necessarily required to be in surface contact with each other. Accordingly, a non-contact portion may be present between the connection section 21 and the antenna 3.

Also, in the above-described embodiment, the sensor section 10 includes the pressure sensor 14. However, the present invention is not limited thereto, and a structure may be adopted in which the sensor section 10 includes a sensor that detects the external environment of the wristwatch case 1, such as a temperature sensor. Also, this electronic component in the present invention is not necessarily required to be a sensor, and may be another electronic component such as a loudspeaker, a microphone, or the switch button 8. Furthermore, in the above-described embodiment, the present invention has been applied to a wristwatch. However, the application target is not necessarily required to be a wristwatch. The present invention can be applied to various timepieces such as a travel watch, an alarm clock, a table clock, and a wall clock. Also, the present invention can be applied not only to timepieces but also to various electronic devices such as a portable telephone and a portable terminal.

While the present invention has been described with reference to the preferred embodiments, it is intended that the invention be not limited by any of the details of the description therein but includes all the embodiments which fall within the scope of the appended claims.

What is claimed is:

1. An antenna device comprising:

a case main body comprising synthetic resin;

an antenna comprising metal and formed in a ring shape, wherein the antenna is provided on an upper portion of the case main body so as to receive radio wave;

an electronic component provided on a side portion of the case main body; and a protective connection member comprising metal, wherein the protective connection member includes:

a protection section provided to cover at least an outwardly exposed portion of the electronic component; and a connection section extending from the protection section and electrically connected to the antenna to increase capacitive coupling.

2. The antenna device according to claim 1, wherein the protective connection member is formed to have a plate shape, and wherein the connection section is arranged to be opposed to the antenna.

3. The antenna device according to claim 2, wherein the connection section of protective connection member is formed to be opposed to and to resiliently come in surface contact with the antenna to reduce contact resistance with respect to the antenna.

4. The antenna device according to claim 3, wherein the connection section of the protective connection member which is electrically connected to the antenna is (i) extended from outside of the electronic component along an upper surface of the case main body, (ii) folded back, and (iii) arranged to be opposed to a lower surface of the antenna.

5. The antenna device according to claim 2, wherein the connection section of the protective connection member which is electrically connected to the antenna is (i) extended from outside of the electronic component along an upper surface of the case main body, (ii) folded back, and (iii) arranged to be opposed to a lower surface of the antenna.

6. The antenna device according to claim 5, wherein the case main body and the antenna define an insertion groove therebetween, and wherein the connection section of the protective connection member is inserted in the insertion groove to be provided between the case main body and the antenna.

7. The antenna device according to claim 6, wherein the insertion groove has a vertical width from the case main body and the antenna that narrows from an insertion port of the insertion groove into which the connection section is inserted toward an inner portion of the insertion groove.

8. The antenna device according to claim 2, wherein a distance between the electronic component and the antenna is short.

9. The antenna device according to claim 2, wherein the electronic component comprises a sensor configured to detect an environment of outside of the case main body.

10. The antenna device according to claim 1, wherein the connection section of the protective connection member is formed to resiliently come in surface contact with the antenna to reduce contact resistance with respect to the antenna.

11. The antenna device according to claim 10, wherein the connection section of the protective connection member which is electrically connected to the antenna is (i) extended from outside of the electronic component along an upper surface of the case main body, (ii) folded back, and (iii) arranged to be opposed to a lower surface of the antenna.

12. The antenna device according to claim 11, wherein the case main body and the antenna define an insertion groove therebetween, and wherein the connection section of the protective connection member is inserted in the insertion groove to be provided between the case main body and the antenna.

13. The antenna device according to claim 12, wherein the insertion groove has a vertical width from the case main body and the antenna that narrows from an insertion port of the insertion groove into which the connection section is inserted toward an inner portion of the insertion groove.

14. The antenna device according to claim 10, wherein a distance between the electronic component and the antenna is short.

15. The antenna device according to claim 1, wherein the connection section of the protective connection member which is electrically connected to the antenna is (i) extended from outside of the electronic component along an upper surface of the case main body, (ii) folded back, and (iii) arranged to be opposed to a lower surface of the antenna.

16. The antenna device according to claim 15, wherein the case main body and the antenna define an insertion groove therebetween, and wherein the connection section of the protective connection member is inserted in the insertion groove to be provided between the case main body and the antenna.

17. The antenna device according to claim 16, wherein the insertion groove has a vertical width from the case main body and the antenna that narrows from an insertion port of the insertion groove into which the connection section is inserted toward an inner portion of the insertion groove.

18. The antenna device according to claim 1, wherein a distance between the electronic component and the antenna is short.

19. The antenna device according to claim 1, wherein the electronic component comprises a sensor configured to detect an environment of outside of the case main body.

20. A timepiece comprising the antenna device according to claim 1.

* * * * *